US005588280A

United States Patent [19]

Kotsiopoulos

[11] Patent Number: 5,588,280

[45] **Date of Patent: *Dec. 31, 1996**

[54] COUPON INSERTING APPARATUS AND METHOD

[75] Inventor: Thomas G. Kotsiopoulos, Northfield, Ill.

[73] Assignee: Carol Joyce Witt, Lake Zurich, Ill.

[ * ] Notice: The term of this patent shall not extend beyond the expiration date of Pat. No. 5,079,901.

[21] Appl. No.: 486,766

[22] Filed: Jun. 7, 1995

Related U.S. Application Data

[63] Continuation of Ser. No. 129,482, Sep. 29, 1993, abandoned, which is a continuation of Ser. No. 819,766, Jan. 13, 1992, abandoned, which is a continuation of Ser. No. 634,923, Dec. 21, 1990, Pat. No. 5,079,901, which is a continuation of Ser. No. 348,860, May 8, 1989, abandoned.

[51] Int. Cl.[6] ..... B65H 35/10

[52] U.S. Cl. ..... 53/435; 53/238; 53/249; 53/474; 53/505; 53/520; 225/4; 225/100

[58] Field of Search ..... 225/4, 100, 106; 53/55, 238, 249, 435, 474, 520, 505

[56] References Cited

U.S. PATENT DOCUMENTS

| | | |
|---|---|---|
| 2,513,093 | 6/1950 | Hageman . |
| 2,618,336 | 11/1952 | Davidson . |
| 2,655,842 | 10/1953 | Baumgartner . |
| 3,127,027 | 3/1964 | Roser et al. . |
| 3,220,158 | 11/1965 | Roser et al. . |
| 3,272,044 | 9/1966 | Obenshain . |
| 3,281,143 | 10/1966 | Mommsen et al. . |
| 3,302,946 | 2/1967 | Anderson . |
| 3,332,324 | 7/1967 | Lehmacher et al. . |
| 3,390,875 | 7/1968 | Beert et al. . |
| 3,481,520 | 12/1969 | Pickering . |
| 3,631,651 | 1/1972 | Kopp . |
| 3,730,411 | 5/1973 | Brockmuller . |
| 3,748,937 | 7/1973 | Long . |
| 3,797,822 | 3/1974 | Anderson . |
| 3,856,196 | 12/1974 | Bayne et al. . |
| 3,881,645 | 5/1975 | Kopp . |
| 3,929,326 | 12/1975 | Seragnoli . |
| 3,991,924 | 11/1976 | Schueler . |
| 4,039,181 | 8/1977 | Prewer . |
| 4,060,168 | 11/1977 | Romagnoli . |
| 4,069,957 | 1/1978 | Moffitt . |
| 4,118,022 | 10/1978 | Rayfield et al. . |
| 4,179,113 | 12/1979 | Gallimore . |
| 4,182,222 | 1/1980 | Stahl . |
| 4,216,952 | 8/1980 | McInerny . |
| 4,217,744 | 8/1980 | Mizutani . |
| 4,222,511 | 9/1980 | Schueler . |
| 4,261,497 | 4/1981 | Roetter et al. . |
| 4,284,221 | 8/1981 | Nagel et al. . |
| 4,323,230 | 4/1982 | Rising . |
| 4,345,753 | 8/1982 | Marshall . |
| 4,351,517 | 9/1982 | Neal et al. . |
| 4,354,894 | 10/1982 | Lewis et al. . |
| 4,375,189 | 3/1983 | Berner et al. . |
| 4,385,537 | 5/1983 | Wolf . |

(List continued on next page.)

FOREIGN PATENT DOCUMENTS

| | | |
|---|---|---|
| 53-38997 | 3/1978 | Japan . |
| 53-31067 | 8/1978 | Japan . |

*Primary Examiner*—Kenneth E. Peterson
*Assistant Examiner*—Allan M. Schrock
*Attorney, Agent, or Firm*—Leydig, Voit & Mayer, Ltd.

[57] ABSTRACT

Apparatus that uses the burster method for positioning coupons from a continuous web at a predetermined time at a predetermined location for insertion is disclosed. A positioning roll pair defines a bight to receive the leading edge of a coupon and are driven by a positioning drive at a continuous predetermined speed. Feeding rolls located upstream of the positioning roll pair in the excess of one coupon length are driven by an intermittent feeding drive at a speed substantially less than the speed of the positioning roll pair. Controlling mechanisms actuate and deactuate the feeding drive in response to a timing mechanism related to container position and a coupon sensing mechanism at a sensing position between the positioning roll pair and the feeding rolls.

20 Claims, 5 Drawing Sheets

U.S. PATENT DOCUMENTS 4,412,631 11/1983 Haker .
4,429,217 1/1984 Hill et al. .
4,455,809 6/1984 Dllaserra .
4,498,894 2/1985 Kuckhermann .
4,516,765 5/1985 Stocco et al. .
4,524,557 6/1985 Silverman et al. .
4,530,200 7/1985 Prewer et al. .
4,651,983 3/1987 Long .
4,658,564 4/1987 Bell, Jr. et al. .
4,668,212 5/1987 Kotani .
4,688,708 8/1987 Irvine et al. .
4,696,145 9/1987 Schmidt et al. .
4,717,043 1/1988 Groover et al. .
4,929,226 5/1990 Focke et al. .
4,982,337 1/1991 Burr et al. .

FIG. 12
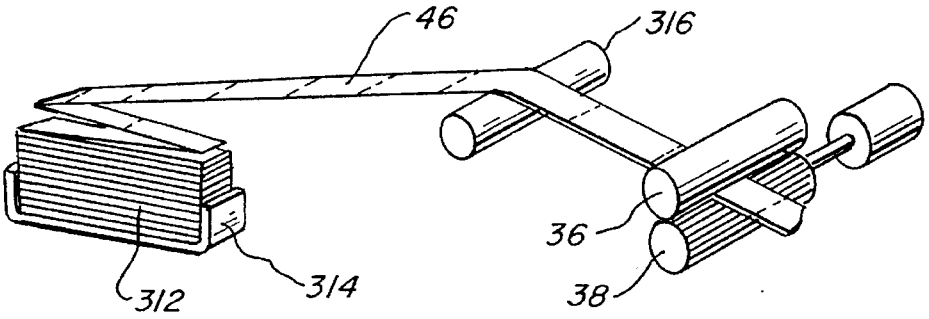
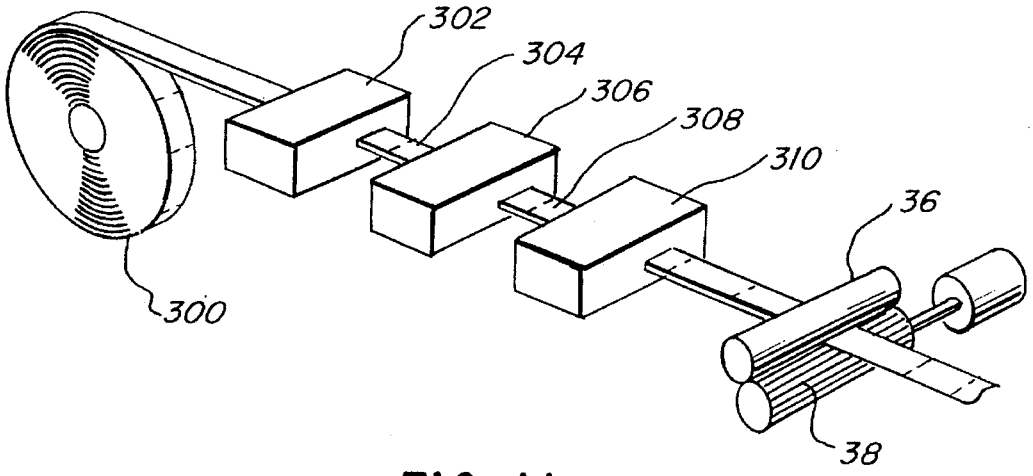
FIG. 11

COUPON INSERTING APPARATUS AND METHOD

This is a continuation of application Ser. No. 08/129,482 filed on Sep. 29, 1993, now abandoned which is a continuation of application Ser. No. 07/819,766, filed on Jan. 13, 1992, now abandoned which is a continuation of application Ser. No. 07/634,923, filed Dec. 21, 1990, now U.S. Pat. No. 5,079,901, which in turn is a continuation of application Ser. No. 07/348,860, filed May 8, 1989 and now abandoned, the subject matter and texts of which are hereby incorporation by reference.

BACKGROUND OF THE INVENTION

The present invention relates to apparatus and methods for inserting coupons into containers moving along a high volume handling system. In particular, the invention separates the forwardmost coupon from a continuous web and injects the coupon into a container as the container passes a designated location for insertion.

It is a common advertising and promotional technique to place coupons or other leaflets into containers, such as cartons for breakfast cereal or snack items, along with the product to be sold. The consumer may use the coupon for whatever purpose intended, such as for discount or future purchases or a rebate. Many devices have therefor been provided to deposit coupons into containers in the present day packaging industry.

This is just one use for the invention which will be described in detail hereinafter. However, it should be understood that the word "coupon" is used in its broadest possible sense to include any coupon, card, sheet, receipt, warranty, premium or other part that can advantageously be handled as described hereinafter. Similarly, "container" is used in the broadest possible sense to include containers such as boxes, tubs, cans and vessels of all kinds as well as any other coupon-receiver which can advantageously be used with this invention.

Typically, coupon inserting devices operate by discharging or positioning a single coupon in each of a plurality of containers which rapidly move along a conveyor system or similar material handling system. The containers are positioned in a particular relationship to the mechanism involved. Known inserting devices, while they perform satisfactorily under certain circumstances, are somewhat unreliable, inflexible and expensive to manufacture, set-up, operate and maintain.

Commonly, coupon dispensing systems require a stack of precut coupons that are individually dispensed from a downwardly sloping channel. One arrangement of this type is disclosed in U.S. Pat. No. 4,530,200. In that system, a pusher element and advancing rollers coact to withdraw the forwardmost coupon from a precut stack of coupons. The coupon is thereby drawn into the downwardly sloping channel to the dispensing location. This arrangement, however, requires a separate cutting and stacking operation before the coupons are ready for the dispensing stage. Another arrangement providing a downwardly sloping tray is disclosed in U.S. Pat. No. 4,179,113. In that system, a reciprocal vacuum head dispenses each coupon from a stack of precut coupons arranged on an inclined tray and places the coupons in a conveyor system which transports the coupons to the containers.

Still other systems require mechanical cutting devices such as a scissors device to separate each coupon from a continuous web. Such an arrangement is disclosed in U.S. Pat. No. 4,354,894. In that system, an advance drum draws the coupons away from the coupon web and toward a scissors device which separates the coupon web into individual coupons. The coupons are thereafter dispensed to moving packages with the use of a conveyor system.

While such prior art systems may function satisfactorily under certain conditions, they are quite complex, often requiring additional coupon processing stages. Such systems, moreover, are susceptible to jamming when operating at high rates of speed. As a result, a coupon may not be placed in every container. On the other hand, two or more coupons may be inadvertently inserted in one container. Moreover, many of the known coupon inserting systems are not capable of accommodating various spacing of the containers and varying conveyor speeds. Further, the known systems do not easily accommodate changes in the location of insertion or the size or shape of the container.

OBJECTS OF THE INVENTION

Accordingly, a general object of the present invention is to provide an improved coupon inserting apparatus that overcomes the deficiencies of the prior art.

Similarly, an object of the present invention is to provide a coupon inserting apparatus that ascertains the location of each of a plurality of containers moving at varying speeds and positively places a coupon at that location at a predetermined time.

An additional object of the present invention is to provide a coupon inserting apparatus capable of detaching a single coupon from a continuous web at high speed and with precision and inserting it into a container.

It is another object of this invention to provide a new and unique method of storing a supply of coupons and efficiently and positively feeding them, one at a time, to a predetermined position at a predetermined time.

Finally, an object of the present invention is to provide a coupon inserting apparatus that may be portably and universally located to operate at varying points of insertion and along varying insertion paths to practice the unique method of this invention.

Other objects and advantages of the invention will become apparent upon reading the following description and appended claims, and upon reference to the accompanying drawings.

SUMMARY OF THE INVENTION

The above objects are accomplished by providing a coupon inserting apparatus that operates on a continuous web of separable coupons. The apparatus separates the forwardmost coupon from a continuous web in a controlled intermittent operation. Successive coupons are connected to each other by spaced-apart weakened portions, such as by perforations, extending transversely of the web. The forwardmost coupon is separated and inserted by rotating downstream rolls which function as a burster to apply separating tension to the coupon. After separating the forwardmost coupon, the coupon inserting apparatus directs the coupon into a container which may be rapidly moving.

The coupon inserting apparatus comprises support means, positioning roll means to separate the forwardmost coupon from the continuous web and dispense the coupon at a predetermined location, and feed roll means to intermittently advance the continuous web toward the positioning roll means. The positioning roll means includes a pair of spaced rolls rotatably mounted relative to the support means and defining a bight to receive the leading edge of the forwardmost coupon. In addition, positioning drive means continuously actuates the positioning roll means to move the forwardmost coupon at a predetermined speed.

The feed roll means includes a pair of spaced rolls located upstream from the positioning roll means by a distance in excess of one coupon length. The feed roll means are oriented to direct the leading edge of the forwardmost coupon into the bight formed by the positioning roll means. Feed drive means intermittently drives the feed roll means and advances the leading edge of the forwardmost coupon toward the bight formed by the positioning roll means. The feed drive means operates at a speed substantially less than the predetermined speed of the positioning roll means so that, upon receipt of the leading edge of the forwardmost coupon, the forwardmost coupon is separated from the next coupon along the weakened web portion separating the coupons.

A specific feature of the present invention utilizes control means to actuate and deactuate the feed drive means. The control means includes timing means and detects the position of a moving target or container. The timing means of the control means determines a predetermined time for the container to reach the point of insertion. The control means also receives information from coupon sensing means located at a coupon sensing position between the positioning roll means and the feed roll means. The coupon sensing means detects the presence of and the absence of a coupon at the coupon sensing position. The control means actuates the feed drive means at the predetermined time and upon sensing of the forwardmost coupon at the sensing location to draw the forwardmost coupon into the bight formed by the positioning means, thereby bursting the forwardmost coupon from the continuous web. The positioning roll means moves the coupon toward the predetermined location of insertion at the predetermined speed. When the forwardmost coupon has exited the coupon sensing position, the coupon sensing means detects absence of the coupon. The control means deactuates the feed drive means upon the sequential sensing of the absence of the forwardmost coupon and the sensing of the next coupon at the coupon sensing position. The inserting apparatus may thereby accomplish feeding of coupons to containers moving at varying rates of speed.

Another particular feature of the present invention is provided by a coupon web supply means that supplies the continuous web of coupons to the feeding roll means. The coupon web supply means includes a flexible feeding chute having an output end that is fixed relative to the support means with an input end and a body that may be flexibly and tortuously positioned relative thereto. The support means of the coupon inserting apparatus is mounted by universal means for angularly positioning the coupon inserting apparatus about a joint. The supply means may include source means feeding the input end of the flexible chute. The source means may include means for storing a roll of preformed coupons in continuous web form, and associated dispensing rollers and the like. The source means may also comprise a storage means for a fan-folded web of coupons and associated dispensing mechanisms. Still another source means may include a source roll of unfolded coupons which make up the web, either pre-perforated or not. In that system, folding rolls and a perforating mechanism, if required, receive the web from the source roll and the folded and perforated web is fed through a take-up means to the input end of the flexible chute. Thus, the coupon inserting apparatus may be positioned to provide insertion of the coupons at varying points of insertion and from various sources.

BRIEF DESCRIPTION OF THE DRAWINGS

FIG. 11 is a diagrammatic representation of the coupon inserting apparatus including a fanfold supply means.

FIG. 12 is a diagrammatic representation of the invention using a fabricating supply means.

DETAILED DESCRIPTION OF THE PREFERRED EMBODIMENTS

The following detailed description will permit a more complete understanding of this invention. However, the embodiments described below are simply examples of the invention and the invention is not limited to these embodiments. Furthermore, the drawings are not necessarily to scale and certain elements may be illustrated by graphic symbols and fragmentary views. In certain instances, details may have been omitted which are not necessary for an understanding of the present invention, including conventional details of fabrication and assembly.

Generally, the present invention relates to an apparatus and method for receiving a continuous web of coupons, pulling the forwardmost coupon away from the continuous web, and dispensing the coupon at a predetermined time into a rapidly moving container as it passes a predetermined location. The device of this invention is intended to be integrated into a full service container processing system, and will supply coupons into the containers at a location at which the containers have been formed, usually have not yet been filled and have not yet been closed.

Figure 1:
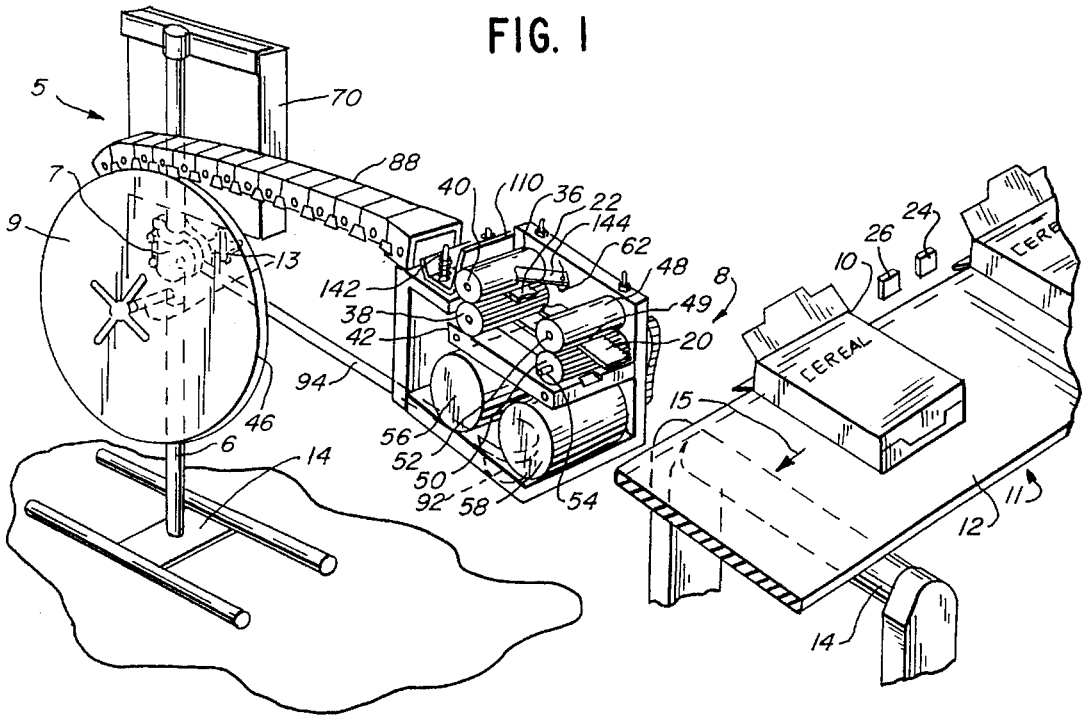
FIG. 1 is a perspective view of one embodiment of the coupon inserting apparatus of the present invention oriented relative to a conveying system, with part of the apparatus removed for clarity.

Turning to the drawings, FIG. 1 shows a perspective view of the coupon inserting system of the present invention including apparatus 5. Coupon inserting apparatus 5 includes an adjustable inserting head 8 which is positioned relative to a conveyor system 11 that transports a plurality of containers 10. The adjustable inserting head 8 is secured to a universal mounting joint 92 at the distal end of a support arm 94. A mounting shaft 94 is secured to a column 6 with use of a rotary joint 7 and securing means 13. The mounting post 6 is supported on a base 14 and also supports an electronic controller 70 which provides logical control for the coupon inserting head 8. It is desired that electronic controller 70 is enclosed in a cabinet suitable for the industrial environment.

FIG. 1 also shows a coupon reel 9 rotatably mounted on an axle which is secured to post 6. Coupon reel 9 provides a housing for a stream of coupons arranged in a continuous web 46 of a type which are to be processed for ultimate insertion into the containers 10. The first coupon in the series, forwardmost coupon 20, is succeeded by the next coupon 22. The coupons are spaced apart and connected by weakened portions extending substantially transversely of the web. Weakening can be accomplished by a line of perforations. A perforated line connects the trailing edge of forwardmost coupon 20 and the leading edge of coupon 22, extending transversely of the continuous web 46. The succeeding coupons are arranged in a similar manner. In the preferred embodiment, the coupons are about the size of a dollar bill, folded along transverse lines of the coupon which extend longitudinally in the web. This configuration permits easy insertion by coupon inserting head 8.

The adjustable inserting head 8 includes positioning roll means shown as a pair of spaced positioning rolls 48 and 50. Positioning rolls 48 and 50 are driven at a predetermined rotational speed by positioning drive means shown as stepper drive motor 58. A servo motor may also be used resulting in higher speed operation and concomitant higher cost. Adjustable inserting head 8 also includes feed roll means shown as a pair of spaced feed rolls 36 and 38 which are located upstream from positioning rolls 48 and 50. Feed rolls 36 and 38 are intermittently driven at a lower rotational speed than the positioning rolls 48 and 50 by feed drive means shown as stepper drive motor 56. Feed rolls 36 and 38 draw the web of coupons 46 through a flexible feed chute 88 and toward the bight formed by positioning rolls 48 and 50.

At a predetermined time, feed rolls 36 and 38 cause the leading edge of the forwardmost coupon 20 to enter the bight 49 between positioning rolls 48 and 50. Positioning rolls 48 and 50 tear the forwardmost coupon 20 from the next succeeding coupon 22 along the perforated line of separation and inject forwardmost coupon 20 at a predetermined location. A photoelectric coupon sensor 62 is also shown disposed between feed rolls 36 and 38 and positioning rolls 48 and 50 to provide electronic controller 70 with sensed coupon location information.

Coupon inserting head 8 is placed relative to a conveyor system 11 that transports containers such as boxes or cartons to successive container processing stations. Conveyor system 11 includes a conveyor belt 12 which rests on support rollers, one such roller being shown as roller 14. A plurality of containers such as container 10 travel on conveyor belt 12 in the direction designated by arrow 15. For maximum production, conveyor belt 12 transports the containers at a high rate of speed.

A pair of photoelectric sensors 24 and 26 are placed relative to the conveyor system 11 and provide electronic controller 70 with timing information related to container position and motion. Electronic controller 70 processes the timing information and the coupon sensor information and actuates and deactuates the feed drive means in accordance therewith. The coupons are thereby inserted, one at a time, into the containers as the containers pass coupon inserting head 8.

Figure 2:
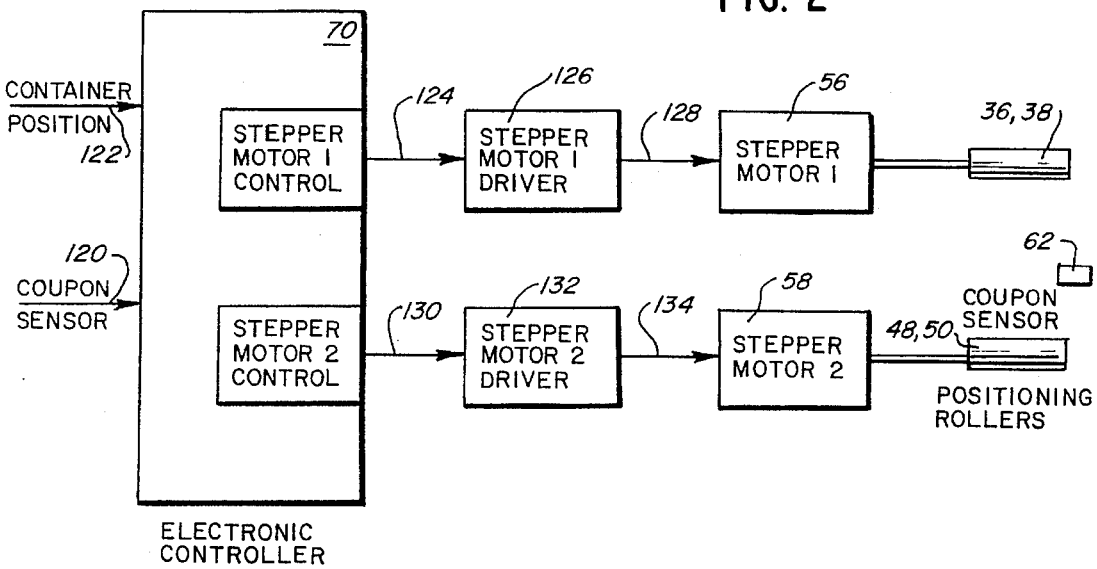
FIG. 2 is a simplified block diagram representation of the coupon inserting apparatus of FIG. 1.

Referring now to FIG. 2, it is a block diagram of the operation of the coupon inserting apparatus of the present invention. The electronic controller 70 receives information from a coupon sensor 62 related to the presence and absence of a coupon at a sensing point between the pair of feed rolls 36, 38 and the pair of positioning rolls 48, 50. The coupon position signal received by controller 70 is designated by a line 120. The electronic controller 70 also receives information related to the position of the forwardmost container designated by a line 122. The controller 70 is preferably microprocessor controlled and may actually be a personal computer. It operates in a logical fashion to provide actuating and deactuating signals on a line 124 to a first stepper motor controller 126. The stepper motor controller 126 provides a controlled pulse train represented by a line 128 to control the feed roll drive means; in this embodiment, stepper motor 56. Stepper motor 56 actuates and deactuates feeding rolls 36 and 38 in response to commands provided by controller 70.

Similarly, electronic controller 70 may provide actuating and deactuating signals represented by a line 130 to a second stepper motor controller 132. Stepper motor controller 132 likewise provides a controlled pulse train on a line 134 for the operation of positioning roll drive means such as stepper motor 58. In a preferred mode of operation, electronic controller 70 provides a signal for operating stepper motor 58 at a continuous rate of speed. Positioning rolls 48 and 50 are thereby rotating at a continuous predetermined speed.

As mentioned above, electronic controller 70 may be a personal computer. Stepper motor controllers 126 and 132 comprise plug-in ramping pulse generators, such as Model No. VCO-1006, manufactured by Servo Systems Co. in Montville, N.J., used with CMD-40 or CMD-50 step motor drivers, also manufactured by Servo Systems Co. The characteristics of the stepper motor controllers 126 and 132 provide for rapid acceleration and deceleration of stepper motors 56 and 58.

Figure 3:
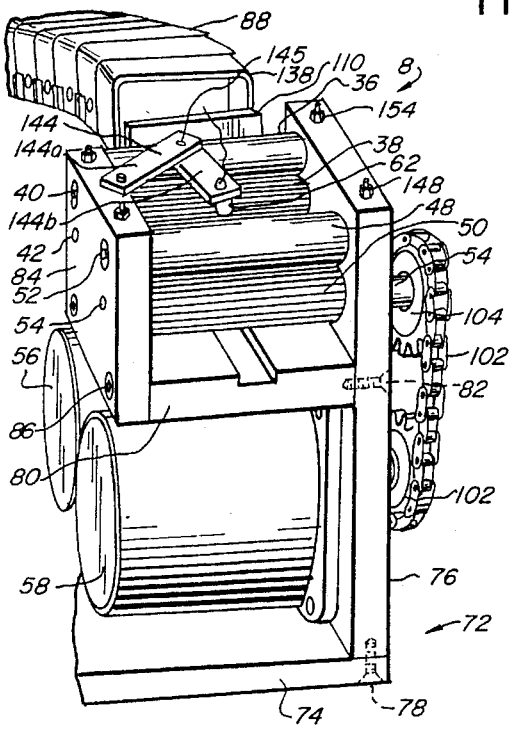
FIG. 3 is a perspective view of the inserting head of the coupon inserting apparatus of FIG. 1.
Figure 4:
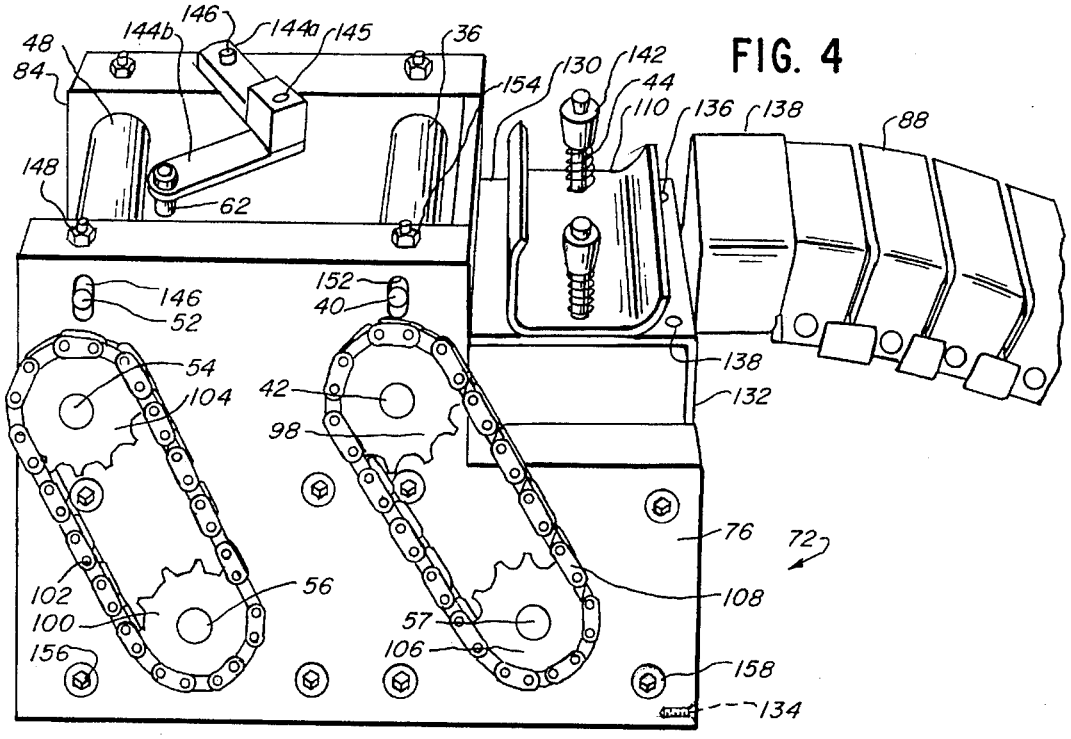
FIG. 4 is an elevational view of the inserting head with a part of the apparatus removed.

The support means for the coupon inserting apparatus is shown in FIGS. 3 and 4. The support means comprises a housing 72 that includes a base support plate 74, two lateral plates 76 and 84, an intermediate support plate 80, a chute support plate 130 and an end support plate 132 (FIG. 4). One of the lateral plates 76 is secured to the base support plate 74 using fastening screws, one of which is designated as fastening screw 78, inserted through an aperture formed in the base support plate 74 and mated with threaded opening formed in the edge of side plate 76. Intermediate support plate 80 is secured to lateral support plate 76 with fastening screws, one of which is designated as fastening screw 82. Fastening screw 82 is inserted in an aperture formed in side plate 76 and mates with a threaded opening formed in the edge of intermediate support plate 80. Similarly, lateral plate 84 is secured to intermediate support plate 80 by fastening screws, one of which is designated as fastening screw 86.

As best seen in FIG. 4, an end support plate 132 is fastened to the bottom support plate 74 and abuts lateral support plates 76 and 84. End support plate 132 is secured to base support plate 74 by fastening screws such as screw 134 which passes through an aperture in end support plate 132 and mates with a threaded hole in the edge of bottom support plate 74. A chute support plate 130 abuts end plate 132 and is joined with end plate 32 with fastening screws 136 and 138. Chute support plate 130 provides a platform for the stream of coupons entering coupon inserting head 8.

The coupon web supply means is also shown in FIGS. 3 and 4. The coupon web supply means includes a flexible feed chute 88 that guides the stream of coupons from the continuous web of coupons 46 (FIG. 1). The flexible feed chute 88 is an enclosed carrier, preferably constructed of a flexible conduit such as Conduflex, manufactured by Kabelschlep. Flexible feed chute 88 is attached to housing 72 by mounting bracket 138. Mounting bracket 138 includes a flange (not shown) that is fastened to end support plate 132 with fastening screws which mate with threaded holes in end support plate 132.

A feeding guide 110 is mounted on chute support plate 130 to provide alignment of the stream of coupons entering coupon inserting head 8. Feeding guide 110 is adjustably mounted with the use of a pair of tensioning screws that are biased to provide light compression to feeding guide 110 against chute plate 30. For example, tensioning screw 142 and spring 144 provide downward force to feeding guide 110. By adjusting the position of tensioning screw 142, feeding guide 110 accommodates different weights and thicknesses of coupons which pass between the chute plate 130 and the guide 110.

FIG. 4 further illustrates the coupon sensor means of the present invention which senses the presence and the absence of a coupon at a sensing location between the positioning rolls 48, 50 and the feeding rolls 36, 38. A light reflective sensor 62 is positioned between the feeding rolls 36, 38 and the positioning rolls 48, 50 with the use of a bracket 144. Sensor 62 provides a light source as well as a sensor that detects the beam generated by the light source when reflected by a coupon positioned at the sensing location. One satisfactory light reflective sensor is a fiber optic sensor manufactured by Omron. Bracket 144 is mounted to one lateral plate 84 of housing 72 by a screw 146 which mates with a thread aperture in lateral plate 84. Bracket 144 may thereby pivot about the axis defined by screw 146 to provide adjustment of the location of sensor 62. Further, bracket 144 may be constructed of cooperating hinge parts **144*a* and 144*b* which are adjustable about a hinge axis 145 to provide further adjustment of the location of coupon sensor 62. The exact location of the sensing position depends upon the particular geometry of the head. The spacing between the feed rolls 36 and 38 and positioning rolls 48 and 50 must always exceed one coupon length and the sensing position be such that the sensor 62 can respond to the gap between the forwardmost coupon 20 and the next coupon when the forwardmost coupon 20 is severed and accelerated. In one embodiment the coupon sensor 62 may be located approximately ¼ inch from the periphery of the positioning rolls 48 and 50 so that the presence of a coupon is detected just before the coupon reaches the bight 49 formed by the rotating positioning rolls 48 and 50. Of course, if coupon sensor 62 is located too close to positioning rolls 48 and 50, the feed roll drive means may not deactuate the feed rolls 36 and 38 in sufficient time to prevent the leadmost edge of a coupon from entering the bight formed by positioning rolls 48 and 50**. In this instance, the system would not be able to control intermittent feeding.

FIGS. 3 and 4 further illustrate the positioning roll means of the present invention. The positioning roll means comprises positioning roll 48 spaced from positioning roll 50. A bight 49 formed by the positioning rolls 48 and 50 draws the leading edge of a coupon to be ejected by positioning rolls 48 and 50 toward a predetermined location where the coupon is desired. Positioning rolls 48 and 50 are rotatably mounted via positioning roll shafts 52 and 54 into apertures with bearing surfaces formed in the lateral plates 76 and 84 of housing 72. As is best seen in FIG. 4, positioning shaft 52 is adjustable within slot 146 of side plate 76. A pair of tensioning screws, such as tensioning screw 148 threaded within a slot in lateral side 76, provide compression to positioning roll shaft 52. Positioning roll 48 may thereby be adjusted to vary the gap between rolls 48 and 50 and accommodate different weights and thicknesses of coupons.

FIGS. 3 and 4 likewise illustrate the feeding roll means of the present invention. The feeding roll means comprises feed rolls 36 and 38 located upstream of the positioning rolls 46 and 48 in excess of one coupon length. Feed roll 36 is rotatably mounted to the lateral sides 76 and 84 of housing 72 via a shaft 40 fitted within slots in lateral sides 76 and 84 having bearing surfaces formed therein. Feed roll 38 is positioned from feed roll 36 and is rotatably mounted to lateral sides 76 and 84 via a shaft 42. Shaft 42 likewise fits within slots in lateral sides 76 and 84 having bearing surfaces formed therein. Shaft 40 is adjustable within a pair of slots, including slot 152, with the use of a pair of tensioning screws such as tensioning screw 154 that mates with a threaded slot formed in lateral plate 76. Tensioning screw 154 provides downward compression to feed roll shaft 40, thereby adjusting the gap between the feed rolls 36 and 38.

Preferably, the positioning rolls 50 and 52 and the feed rolls 36 and 38 are the same diameter, most preferably 0.75 inch. Both sets of rolls are constructed of steel. In the preferred embodiment, one of the feed rolls and one of the rolls 50 are nerled to insure positive control of the coupons.

FIGS. 3 and 4 further illustrate the drive means of the present invention. As shown in FIG. 3, a stepper motor 58 for driving the positioning rolls 48 and 50 is shown. Stepper motor 58 is mounted to the lateral side 76 of housing 72 with the use of mounting screws, one of which is shown as mounting screw 156 which fits into a threaded aperture formed in lateral side 76.

As best seen in FIG. 4, stepper motor 58 includes a drive shaft 56. A linked drive chain 102 traverses a drive sprocket 100 mounted to drive shaft 56 and a driven sprocket 104 mounted to the lower positioning roll shaft 54. The chain 102 thereby transfers torque to the positioning roll shaft 54 and positioning roll 50. Positioning roll 48 is an idler roller and rotates in the opposite direction from lower positioning roller 50 to define the bight 49. In the preferred embodiment, the gear ratio between drive sprocket 100 and driven sprocket 104 is one to one for precise control of the rotation of positioning roll 50.

The feed drive means includes a stepper motor 56 fixedly mounted to the lateral side 76 of housing 72. Four mounting screws, including mounting screw 158 which fits within a threaded aperture formed in lateral side 76, secure stepper motor 56 to housing 72. Stepper motor 56 has a drive shaft 57 carrying a drive sprocket 106. A linked drive chain 108 transfers torque from drive shaft 57 to driven sprocket 98 which, in turn, is mounted to feed roll shaft 42. Feed roll 36 is an idler roller that rotates in the opposite direction from lower feed roll 38 whereby a feed roll bight is defined. The gear ratio between sprocket 106 and sprocket 98 is preferably one to one to provide positive control for the actuation and deactuation of feed roll 38. Timing belts with associated pulley means can also be used to drive positioning rolls 50 and 52 and feed rolls 36 and 38.

Stepper motors 56 and 58 are precisely controllable in both speed and direction. One satisfactory stepper motor is Rapid-Syn, Model No. 34D-9209A, motors manufactured by Computer Devices. While the speed of the motors generally depends upon the load, the stepper motor 58 for driving positioning rolls 48 and 50 were operated at approximately 100 revolutions per minute in one embodiment. Stepper motor 56 driving feed rolls 36 and 38 intermittently must operate at a rotational speed less than that of the positioning rolls. For example, the rotation was 50 revolutions per minute in the example cited. The rotational speeds of stepper motors 56 and 58 will vary depending on the application. It is desired that the motors have very high acceleration and deceleration to achieve a more precise feed of the individual coupons. At lower speeds, actuation and deactuation of the motors is more precisely controllable, but coupon placement is more positive at higher speeds.

While stepper motors are preferred, servomotors or DC motors have also been used successfully. For example, in the arrangement where positioning rolls 50 and 52 are continuously rotating, stepper motor 58 could be replaced by a servomotor to achieve a higher rotational speed for positioning rolls 50 and 52. In this arrangement, the bight 49 formed by positioning rolls 50 and 52 draws the lead edge of the forwardmost coupon 20 at a greater linear speed, increasing the tension between forwardmost coupon 20 and the next succeeding coupon 22 and thereby creating more positive detachment of the trailing edge of forwardmost coupon 20 from the leading edge of the next coupon along the perforated line of separation. The positioning rollers 50 and 52 will also direct the forwardmost coupon 17 toward the predetermined location at an increased rate of speed. This arrangement is particularly useful to fire the forwardmost coupon 20 into a container at a location of insertion fairly distant from positioning rolls 48 and 50.

Figure 5:
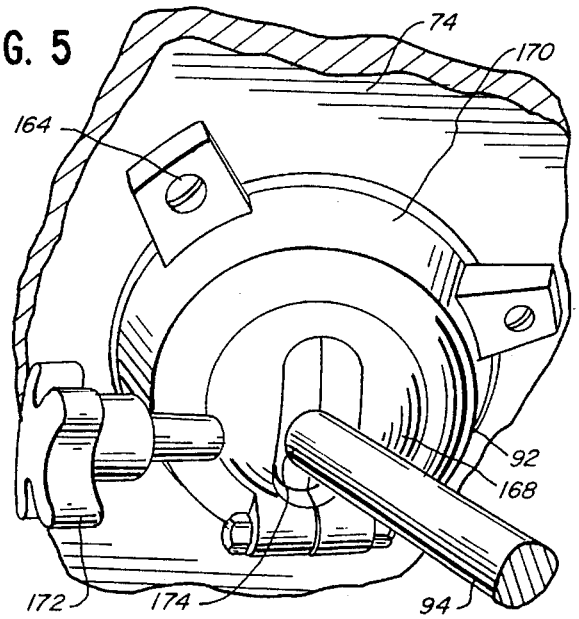
FIG. 5 is a detailed perspective view of a mounting arrangement for the coupon inserting apparatus of FIG. 1 viewed from the bottom of the inserting head.
Figure 6:
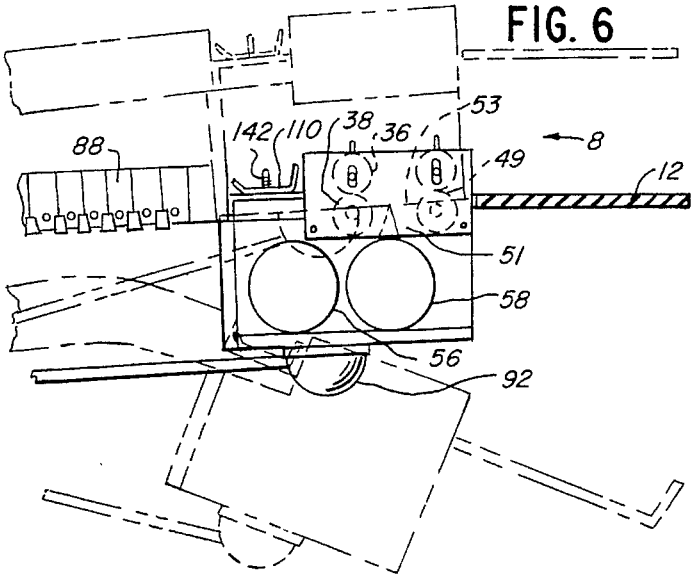
FIG. 6 is a sectional view of a coupon inserting apparatus illustrating the vertical adjustability thereof.
Figure 7:
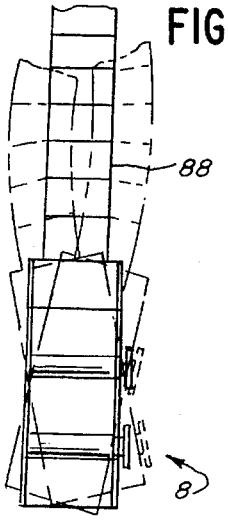
FIG. 7 is a plan view of a coupon inserting apparatus illustrating the horizontal adjustability thereof.

FIGS. 5, 6, and 7 illustrate the adjustability of portable feed head 8 to locate the coupon inserting apparatus 5 to define particular points of insertion. As shown in FIG. 5, a universal mounting joint 92 is secured to the lower side of the support plate 74. Three equispaced screws 164, pass through apertures in universal mounting joint 92 and mate with a threaded aperture in support plate 74 to secure universal mounting joint 92 thereto.

Universal mounting joint 92 includes a ball portion 168 that interfits in a socket portion 170, and is universally rotatable within socket portion 170. A shaft 94 extends from an arcuate opening 174 provided in ball portion 168 and is free to rock therein. A securing means 172 fixedly secures socket portion 170 and shaft 94 in the desired position. As best seen in FIG. 1, shaft 94 is pivotally connected to the vertical support 6 of the coupon inserting apparatus.

FIG. 6 illustrates the coordination of the universal mounting joint 92 and the flexible feed chute 88. As is shown in FIG. 1, the coupon inserting head 8 may be vertically positioned by shifting clamp 7 vertically on column 6 and arm 94 can be tilted about a rotary joint 7 to define a support point for head 8. Head 8 can then be universally positioned about that support point by universal joint 170. Thereby, positioning rolls 48 and 50 may be oriented as desired relative to a multiplicity of conveyor belt configurations. Thus, the advantages of a flexible feed chute, such as feed chute 88, becomes apparent. Feed chute 88 provides a continuous path for the stream of coupons fed into inserting head 8 irrespective of feed head 8 orientation. For example, coupon inserting head 8 works just as well when directed downwardly to inject coupons toward an insertion location from above.

Similarly, FIG. 7 illustrates the horizontal adjustability of coupon inserting head 8. This may be accomplished by repositioning stand 14 or rotating arm 94 about standard 6. Likewise, feed chute 88 provides a continuous path for the stream of coupons and enables inserting head to be horizontally adjusted about universal joint 92.

Figure 10:
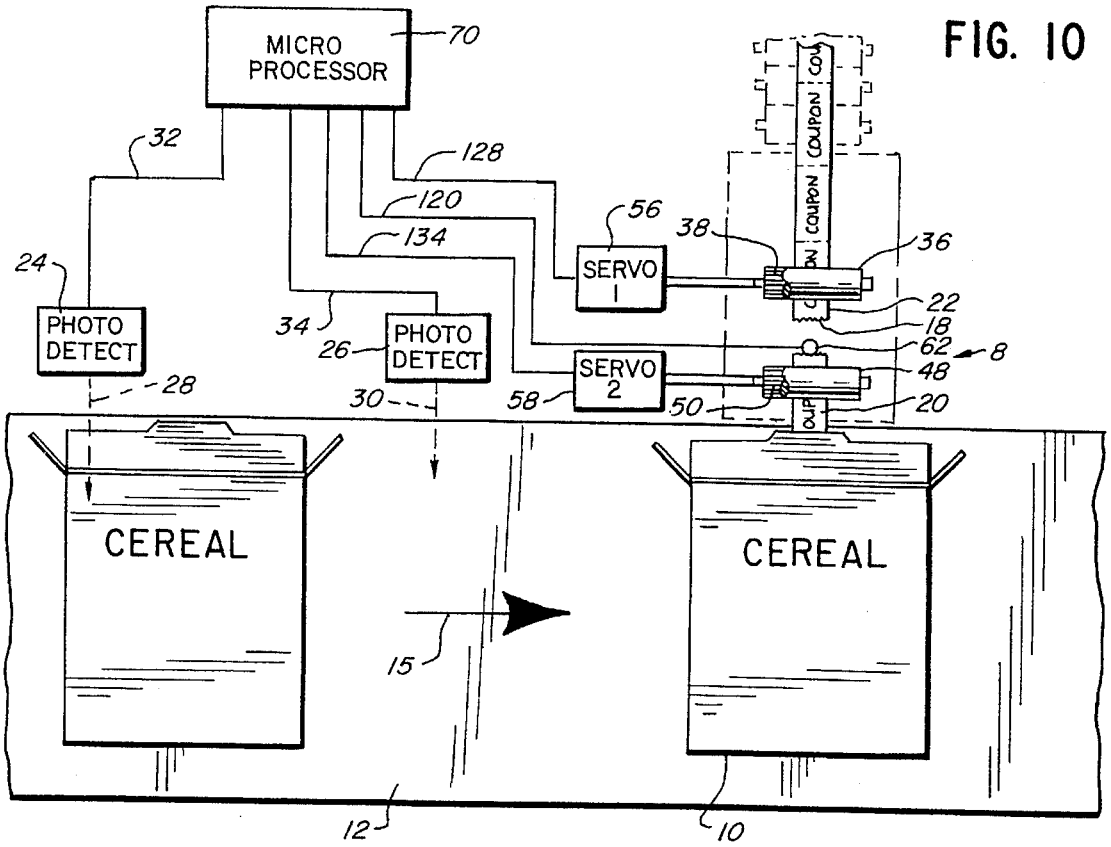
FIG. 10 is a diagrammatic representation of the coupon inserting apparatus of the present invention.

FIG. 10 illustrates the timing system associated with the present invention. A first reflective photoelectric sensor 24 and a second reflective photoelectric sensor 26 are positioned relative to a conveying system 11 which transports containers 10. The beams generated by the sources of light provided by light reflective sensors 24 and 26 are shown by lines 28 and 30 transverse to the container path. In the preferred embodiment, sensors 24 and 26 operate the same as coupon sensor 62. As the leading edge of a container interrupts the beam generated by first light reflective sensor 24, a timing signal on the line 32 is received by signal processor 70. The container thereafter interrupts the beam generated by second light reflective sensor 26, and a second timing signal on the line 34 is received by the signal processor 70.

From these data, signal processor 70 is programmed to calculate the line speed of each container. Also, a determination of the time at which the container will reach a predetermined location of insertion is also calculated. At the appropriate time, signal processor 70 commands the feed drive means of the system to actuate, thereby accelerating feed rolls 36 and 38 and moving the forwardmost coupon toward the bight formed by positioning rolls 48 and 50.

The timing means also includes a timing adjustment factor to allow the coupon inserting head 8 to inject coupons into containers at varying distances relative to the positioning rolls 48 and 50. The timing adjustment factor is software controlled. For example, if the predetermined location for insertion is relatively far away from positioning rolls 48 and 50, the timing adjustment factor will decrease any delay in the actuation of the feed rolls 36 and 38. The forwardmost coupon will therefore be moved into the positioning rolls 48 and 50, burst from the next succeeding coupon, and dispensed toward the predetermined location for insertion at a time before the container reaches the point of insertion.

Other data including the rotational speed of stepper motors 56 and 58, are necessary to accomplish a suitable and reliable feed. The rotational speed of stepper motor 56 and the rotational speed of feed rolls 36 and 38 must be known to coordinate the timing of the forwardmost coupon 20 entering the bight 49 with container position. Likewise, the rotational speed of stepper motor 58 and positioning rolls 48 and 50 must be set to move forwardmost coupon at a known linear speed for a successful feed.

A variation of the timing means is provided with one operating light reflective sensor, for example, light reflective sensor 24. In this arrangement, the containers must be travelling at a constant linear speed. The processor 70 is preprogrammed with speed data coordinated with the constant speed of the containers. As the forwardmost edge of a container interrupts the beam generated by light reflective sensor 24, a timing signal represented by line 32 is received by processor 70, indicative of the container position. Using the preprogrammed speed data, the processor 70 makes a determination of the interval necessary for the container to reach the predetermined point of insertion.

Figure 8:
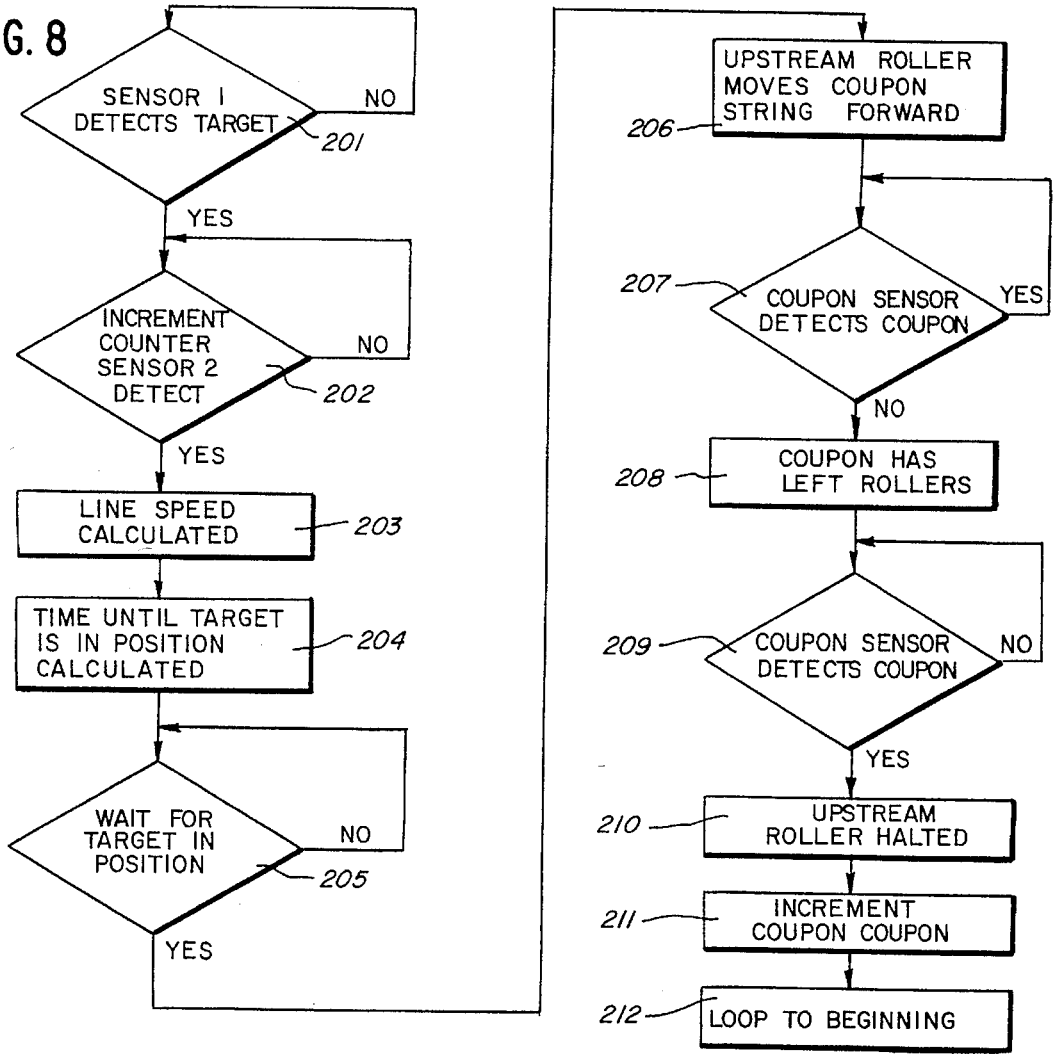
FIG. 8 is a flow diagram of the coupon and package processing steps in accord with the coupon inserting apparatus and method of the present invention.
Figure 9:
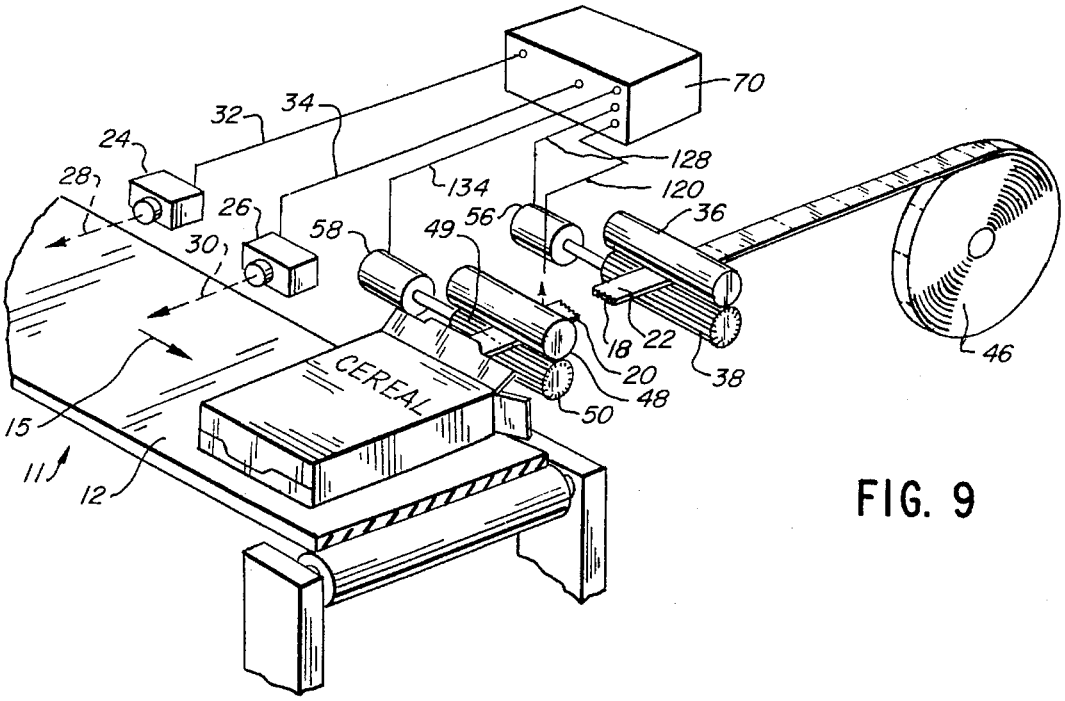
FIG. 9 is a highly simplified perspective view of the coupon inserting apparatus of the present invention.

FIGS. 8, 9 and 10 illustrate the operation of coupon inserting apparatus 5. Signal processor 70 provides logical control for the coupon inserting head 8. Signal processor 70 receives a signal on line 32 from the first light reflective sensor 24 corresponding to the detection of a container moving in a direction indicated by arrow 15. As the container interrupts the beam generated by the second light reflective sensor 26, signal processor 70 receives a signal on line 34 from the second light reflective sensor 26. From these data, processor 70 calculates the line speed associated with the moving container, and thereby calculates the time interval necessary for the moving container to reach the location of insertion. This interval determines the predetermined time for actuation of head 8 for insertion of the forwardmost coupon 20 into an associated container.

At the appropriate time, processor 70 applies a signal on a line 128 via stepper motor driver 126 to actuate stepper motor 56. Stepper motor 56 thereby drives feed rolls 36 and 38 which move forwardmost coupon 20 toward the bight 49 defined by positioning rolls 48 and 50. The forwardmost coupon 20 interrupts coupon sensor 62 as it is drawn toward positioning rolls 48 and 50. Sensor 62 provides a signal on a line 120 to processor 70 to indicate the presence of forwardmost coupon 20.

During this operation, positioning rolls 48 and 50 are driven by stepper motor 58 at a constant predetermined rotational speed which is greater than the rotational speed of feed rolls 36 and 38. The bight 49 formed by positioning rolls 48 and 50 receives the leading edge of forwardmost coupon 20 while the perforated line separating the trailing edge of forwardmost coupon 20 and the leading edge of the next succeeding coupon is between feed rolls 36 and 38 and the sensing position defined by sensor 62. The tensile force between positioning rolls 48 and 50 and feed rolls 36 and 38 sever the forwardmost coupon 20 from the next succeeding coupon 22 at perforated line 18. Positioning rolls 48 and 50 thereafter rapidly dispense forwardmost coupon 20 at the predetermined location of insertion. Forwardmost coupon 20 is thereby injected into the appropriate container as it intercepts the predetermined location of insertion and this causes the light source provided by sensor 62 to be uninterrupted.

As the forwardmost coupon 20 is severed from the next coupon 22, coupon sensor 62 senses the absence of a coupon at the sensing point between the feed rolls 36 and 38 and the positioning rolls 48 and 50. An appropriate signal is received by processor 70 on line 120. The next coupon 22 continues to be drawn by feed rolls 36 and 38 and interrupts the coupon sensor 62 providing the appropriate signal to processor 70. Upon the sequential sensing of the absence of a coupon followed by the presence of a coupon, processor 70 sends the appropriate signal via line 128 to deactuate stepper motor 56, thereby deactuating the feed rolls 36 and 38. Processor 70 thereafter awaits the processing of information with respect to the next container that passes the first light reflective sensor 24. The next coupon is then inserted in the manner described above.

In another embodiment of the coupon inserting apparatus, signal processor 70 provides the appropriate signals to control stepper motor 56 for driving the feed rolls 36 and 38 and also stepper motor 58 for driving positioning rolls 48 and 50. In this mode of operation, stepper motor 58 is actuated during the coupon insertion routine and deactuated while the next succeeding container is arriving at the predetermined location for insertion. Maximized energy efficiency and reduced wear may thereby be achieved during a slower moving operation. This arrangement is appropriate for containers travelling at slower speeds.

The signal processor 70 must be programmed to provide the appropriate signals for controlling stepper motors. At the appropriate time determined by the timing means, the controller 70 provides a signal on line 134 to actuate stepper motor 58 for driving the positioning rolls 48 and 50 as well as a signal via line 128 to actuate stepper motor 56 for driving feed rolls 36 and 38. Stepper motor 58 should be actuated before stepper motor 56 is actuated to accomplish bursting of the coupon. That is, positioning rolls 48 and 50 must be rotating at a sufficient speed to draw the leading edge of the forwardmost coupon into the bight formed by positioning rolls 48 and 50 when the coupon arrives.

In this regard, a breaker member 51 (diagrammatically shown in broken lines in FIG. 6) may be placed between positioning rolls 48 and 50 and feed rolls 36 and 38. The breaker member is generally transverse to the path of the stream of coupons entering feed rolls 36 and 38, and has a portion extending in the coupon path 53. It is desired that breaker member is slightly sloped, having one side elevated relation to the other side. As the forwardmost coupon is drawn by the feed rolls 36 and 38 toward the positioning rolls 48, 50, the coupon travels over the breaker member 51. When the bight formed by positioning rolls 48 and 50 receives the leading edge 19 of forwardmost coupon 20, the perforated line 18 which separates the trailing edge of forwardmost coupon 20 and the leading edge of the next coupon 22 is approximately aligned with the breaker member 51. The tension provided between positioning rolls 48 and 50 and feed rolls 36 and 38 is thereby concentrated on one side of perforated line 18 with the use of the breaker member. The trailing edge of forwardmost coupon 20 more easily tears from the next succeeding coupon in this manner because bursting is initiated in a local area determined by the interference from the portion of the breaker member 51 protruding into the coupon path 53. A protuberant breaker member is particularly useful when positioning rolls 48 and 50 are rotating at relatively low speeds.

In another mode of operation, controller 70 operates stepper motor 56 and stepper motor 58 to burst the forwardmost coupon from the next succeeding coupon in the manner described above. Controller 70 then operates to rapidly decelerate stepper motor 58 before the trailing edge of forwardmost coupon 20 exists the bight formed by positioning rolls 48 and 50, trapping the forwardmost coupon 20 between positioning rolls 48 and 50 in a stationary position. At the appropriate time, controller 70 sends a signal in response to the timing data generated in relation to the container position to actuate stepper motor 58. Positioning rolls 48 and 50 are thereby accelerated, dispensing the coupon into the container.

In this mode of operation, the feed rolls 36 and 38 may be actuated during the wait period while forwardmost coupon 20 is trapped in the bight formed by positioning rolls 48 and 50 to move the next coupon 22 into a position between positioning rolls 48 and 50 and feed rolls 36 and 38. The coupon advances until the coupon sensor detects the presence of the next coupon 22. In this manner, the overall speed of the container processing system may be increased.

In the preferred embodiment the coupon supply is maintained on a roll or drum such as drum 9. In an alternate embodiment, shown in FIG. 11, coupon inserting head 8 is part of a fully integrated system, whereby a large roll of unfolded coupons 300 is fed to a folding, perforating and take-up apparatus. The unfolded coupons from roll 300 are fed to longitudinal folder 302. The output of folder 302 is a longitudinally folded stream 304 which is fed to a perforator 306. The output 308 of perforator 306 is identical to the web 46 shown in FIG. 1 and is fed through a take-up system 310 to feeder rolls 36 and 38. Take-up system 310 is of a conventional type used to permit relatively continuous operation of the folder 30 and perforator 306 while feeding intermittent feed rolls 36 and 38.

FIG. 12 diagrammatically shows a stack of prefolded and perforated coupons 46 formed into a fan-fold 312 in a tray 314. The web 46 is fed over one or more guide rolls 316 directly into the feed rolls 36 and 38. Thereafter this embodiment functions in exactly the same manner as the system of FIG. 1.

While a particular embodiment of the invention has been shown and described, it will be understood, of course, that the invention is not limited thereto, since modifications may be made and other embodiments of the principles of this invention will occur to those skilled in the art to which this invention pertains, particularly upon considering the foregoing teachings.

What is claimed is:

1. An apparatus for delivering coupons, one at a time, to moving containers as said containers move past a predetermined location, said coupons being provided in a continuous web wherein a trailing edge of a forwardmost coupon is detachably connected to a leading edge of a successive coupon by a weakened separable portion disposed therebetween, each coupon following said successive coupon being similarly connected in said web, said apparatus comprising:

opposed positioning rolls rotatably mounted and defining a bight for receiving the leading edge of said forwardmost coupon;

opposed feed rolls disposed upstream from said positioning rolls, said feed rolls rotatably mounted and oriented for directing the leading edge of said forwardmost coupon into said bight of said positioning rolls;

a positioning drive mechanism coupled to at least one of said positioning rolls for driving said positioning rolls and moving said forwardmost coupon at a first speed;

a feed drive mechanism coupled to at least one of said feed rolls for driving said feed rolls and moving the leading edge of said forwardmost coupon toward said bight of said positioning rolls at a speed less than said first speed, said feed drive mechanism operating in response to a first output signal whereby said positioning rolls, upon receipt of the leading edge of said forwardmost coupon in said bight, separate the trailing edge of said forwardmost coupon from the leading edge of said successive coupon and deliver the separated forwardmost coupon to said predetermined location;

a coupon sensor disposed between said positioning rolls and said feed rolls for detecting the presence and absence of coupons at a sensing position therebetween;

a container sensor for detecting the movement of said containers; and a control circuit for providing said first output signal to said feed drive mechanism, said first output signal being determined based upon a timing signal dependent on the movement of said containers from said container sensor and a sensing signal relating to the presence and absence of coupons at said sensing position from said coupon sensor, said control circuit providing said first output signal in response to said timing signal and said sensing signal so that said positioning rolls separate said forwardmost coupon from said continuous web and deliver the separated forwardmost coupon to said predetermined location at a predetermined time when said moving container passes said predetermined location.

2. The apparatus according to claim 1 further comprising a breaker member having at least a portion thereof disposed between said feed rolls and said positioning rolls to facilitate the separation of the trailing edge of said forwardmost coupon from the leading edge of said successive coupon.

3. The apparatus according to claim 2 wherein said breaker member is fixedly mounted at least partially between said feed rolls and said positioning rolls.

4. The apparatus according to claim 2 wherein said breaker member is wedge shaped and extends substantially transversely of said continuous web.

5. The apparatus according to claim 1 wherein said control circuit provides said first output signal to said feed drive mechanism to rotate said feed rolls in an intermittent fashion for supplying successive coupons to said positioning rolls.

6. The apparatus according to claim 1 wherein said positioning drive mechanism operates upon the receipt of a second output signal, said control circuit providing said second output signal in response to said timing signal and said sensing signal.

7. The apparatus according to claim 1 wherein said positioning rolls are rotatably and fixedly mounted in excess of one coupon length from said feed rolls.

8. An apparatus for inserting coupons into moving containers as said containers move past a predetermined point of insertion, said coupons being provided in a continuous web wherein a trailing edge of a first coupon is detachably connected to a leading edge of a successive coupon by a weakened separable portion disposed therebetween and extending transversely of said web, each coupon thereafter being similarly connected in said web, said apparatus comprising:

a delivery subassembly including first and second positioning rolls for delivering said first coupon to said predetermined point of insertion, said first and second positioning rolls being operable to engage said first coupon to separate the trailing edge of said first coupon from the leading edge of said successive coupon along said separable portion;

a coupon advancing subassembly including feed rolls disposed upstream from said positioning rolls for engaging and advancing said first coupon toward said delivery subassembly and for retaining said successive coupon while said first coupon is engaged by said positioning rolls, said coupon advancing subassembly being operable upon receipt of a first output signal;

a coupon sensor disposed between said delivery subassembly and said coupon advancing subassembly for detecting the presence and absence of coupons at a sensing position therebetween;

a container sensor disposed in relation to said containers for detecting the movement of said containers; and a control circuit for providing said first output signal to said coupon advancing subassembly, said first output signal being determined based upon a timing signal from said container sensor and a sensing signal from said coupon sensor, said control circuit providing said first output signal to said coupon advancing subassembly in response to said timing signal and said sensing signal so that said coupon advancing subassembly separates said forwardmost coupon from said continuous web and inserts the separated forwardmost coupon into a moving container as said container moves past said predetermined point of insertion at a predetermined time.

9. The apparatus according to claim 8 further comprising a breaker member having at least a portion thereof positioned between said delivery subassembly and said coupon advancing subassembly, said breaker member facilitating separation of the trailing edge of said first coupon from the leading edge of said successive coupon.

10. The apparatus according to claim 9 wherein said breaker member initiates separation of the trailing edge of said first coupon from the leading edge of said successive coupon in a local area determined by the position of said breaker member.

11. The apparatus according to claim 8 wherein said control circuit provides said first output signal to said coupon advancing subassembly to rotate said feed rolls in an intermittent fashion for supplying successive coupons to said positioning rolls.

12. The apparatus according to claim 8 wherein said delivery subassembly operates upon the receipt of a second output signal, said control circuit providing said second output signal in response to said timing signal and said sensing signal.

13. The apparatus according to claim 8 wherein said first and second positioning rolls are rotatably mounted to maintain a substantially constant distance between each other during operation.

14. A coupon processing system for delivering coupons to moving receptacles as said receptacles move past a predetermined point of insertion, said coupon processing system comprising:

a coupon supply including a continuous web of coupons wherein a trailing edge of a first coupon is connected to a leading edge of a successive coupon by a separable portion therebetween, each coupon thereafter being similarly connected in said continuous web;

a coupon delivery assembly disposed downstream of said coupon supply, said coupon delivery assembly including a set of feed rolls and a set of positioning rolls disposed downstream of said feed rolls, said feed rolls responding to a first control signal to engage and advance said first coupon toward said positioning rolls, said feed rolls retaining said successive coupon while said first coupon is engaged by said positioning rolls so as to apply a bursting tension between said first coupon and said successive coupon; and control circuitry including a coupon sensor disposed between said feed rolls and said positioning rolls for detecting the presence and absence of coupons therebetween and a receptacle sensor for detecting the movement of said receptacles, said first control signal being determined by said control circuitry based upon a timing signal from said receptacle sensor and a sensing signal from said coupon sensor, said first control signal being provided at such a time that said first coupon is separated from said successive coupon and is delivered to a receptacle as said receptacle moves past said predetermined point of insertion at a predetermined time after said forwardmost coupon has been separated from said successive coupon.

15. An apparatus for delivering coupons, one at a time, to moving containers as said containers move past a predetermined location, said coupons being provided in a continuous web wherein a trailing edge of a forwardmost coupon is detachably connected to a leading edge of a successive coupon and each coupon after said successive coupon is similarly connected in said continuous web, said apparatus comprising:

a coupon supply including said continuous web of coupons;

rotatably mounted positioning rolls disposed downstream from said coupon supply, said positioning rolls receiving the leading edge of said forwardmost coupon and moving said forwardmost coupon at a first speed;

rotatably mounted feed rolls disposed upstream from said positioning rolls, said feed rolls directing the leading edge of said forwardmost coupon toward said positioning rolls, said feed rolls driving said forwardmost coupon at a speed less than said first speed, said feed rolls being driven in response to a first output signal;

a breaker member contacting said continuous web between said feed rolls and said positioning rolls for facilitating the separation of the trailing edge of said forwardmost coupon from the leading edge of said successive coupon;

a coupon sensor disposed between said positioning rolls and said feed rolls for detecting the presence and absence of coupons at a sensing position therebetween;

a container sensor disposed in relation to said containers for detecting the movement of said containers; and a control circuit receiving a timing signal dependent on the movement of said containers from said container sensor, receiving a sensing signal dependent the presence and absence of coupons at said sensing position from said coupon sensor, and providing said first output signal to said feed rolls, said control circuit providing said first output signal to said feed rolls at such a time that said forwardmost coupon is separated from said successive coupon and is delivered to one of said moving containers as said container moves past said predetermined location.

16. The apparatus according to claim 15 wherein said breaker member is fixedly disposed between said feed rolls and said positioning rolls.

17. The apparatus according to claim 15 wherein said breaker member applies a force substantially normal to said continuous web.

18. The apparatus according to claim 15 wherein said breaker member applies a normal force to said continuous web which acts in cooperation with an axial force generated by said feed rolls and positioning rolls to separate said forwardmost coupon from said successive coupon at a weakened portion therebetween.

19. A method of manufacturing containers having coupons therein, the method comprising the steps of:

providing a continuous web of coupons wherein a trailing edge of a forwardmost coupon is detachably connected to a leading edge of a successive coupon by a weakened separable portion therebetween and wherein each coupon after the successive coupon is similarly connected;

providing a supply of containers which move past a predetermined point of insertion;

providing a coupon delivery subassembly located downstream of the continuous web of coupons and upstream of the predetermined point of insertion, the coupon delivery subassembly including feed rolls and positioning rolls, the positioning rolls being disposed downstream of the feed rolls and rotating at a first angular velocity, the feed rolls advancing the forwardmost coupon toward a bight formed between the positioning rolls in response to an output signal, the output signal selectively rotating the feed rolls at a second angular velocity;

sensing the presence and absence of the forwardmost coupon at a sensing position between the feed rolls and the positioning rolls and generating a sensing signal pertaining to the presence and absence of coupons at the sensing position;

sensing the movement of the containers relative to the predetermined point of insertion and generating a timing signal based upon the movement of the containers;

coupling the sensing signal and the timing signal to a control circuit, the control circuit providing the output signal to the feed rolls in response to the timing and sensing signals so that the feed rolls and the positioning rolls separate the forwardmost coupon from the successive coupon when at least a portion of the forwardmost coupon is at the sensing position and appropriate movement of one of the containers is detected, and delivering the separated forwardmost coupon to one of the moving containers as said container moves past the predetermined point of insertion.

20. A method of delivering coupons, one at a time, to moving containers as the containers move past a predetermined point of insertion, the coupons being provided in a continuous web wherein a trailing edge of a forwardmost coupon is detachably connected to a leading edge of a successive coupon by a weakened separable portion therebetween and wherein each coupon after the successive coupon is similarly connected in the web, the method thereby manufacturing containers having coupons therein and comprising the steps of:

sensing the movement of the containers relative to the predetermined point of insertion and generating a timing signal based upon the movement of the containers, the timing signal pertaining to when one of the containers will be at the predetermined point of insertion;

sensing the presence and absence of the forwardmost coupon at a sensing position and generating a sensing signal pertaining thereto;

providing a coupon separation and delivery subassembly between the continuous web of coupons and the predetermined point of insertion, the subassembly including feed rolls and positioning rolls, the positioning rolls disposed downstream of the feed rolls;

advancing the continuous web of coupons utilizing the feed rolls;

providing a first output signal based in part upon the timing signal and the sensing signal; and separating the forwardmost coupon from the successive coupon in response to the first output signal and delivering the forwardmost coupon to one of the moving containers as said container moves past the predetermined point of insertion.

* * * * *

UNITED STATES PATENT AND TRADEMARK OFFICE

CERTIFICATE OF CORRECTION

PATENT NO. : 5,588,280

DATED : December 31, 1996

INVENTOR(S) : Thomas G. Kotsiopoulos

It is certified that error appears in the above-indentified patent and that said Letters Patent is hereby corrected as shown below:

col. 16, line 17, after "dependent" insert --on--.

Signed and Sealed this

Twenty-second Day of April, 1997

Bruce Lehman

*Attest:*

BRUCE LEHMAN

*Commissioner of Patents and Trademarks*

*Attesting Officer*